US010110980B2

(12) United States Patent
Epping

(10) Patent No.: US 10,110,980 B2
(45) Date of Patent: Oct. 23, 2018

(54) GUITAR AMPLIFIER MICROPHONE UNIT

(71) Applicant: Sennheiser electronic GmbH & Co. KG, Wedemark (DE)

(72) Inventor: Heinz Epping, Hildesheim (DE)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 0 days.

(21) Appl. No.: 15/373,406

(22) Filed: Dec. 8, 2016

(65) Prior Publication Data

US 2017/0171653 A1 Jun. 15, 2017

(30) Foreign Application Priority Data

Dec. 9, 2015 (DE) ..... 10 2015 121 410

(51) Int. Cl.

| | |
|---|---|
| ***H04R 9/08*** | (2006.01) |
| ***H04R 11/04*** | (2006.01) |
| ***H04R 17/02*** | (2006.01) |
| ***H04R 19/04*** | (2006.01) |
| ***H04R 21/02*** | (2006.01) |
| ***H04R 1/08*** | (2006.01) |
| ***H04R 1/46*** | (2006.01) |
| ***H04R 1/04*** | (2006.01) |

(52) U.S. Cl.
CPC ..... *H04R 1/08* (2013.01); *H04R 1/04* (2013.01); *H04R 1/46* (2013.01)

(58) Field of Classification Search
CPC ..... H04R 1/08; H04R 1/04; H04R 1/46
USPC ..... 381/366
See application file for complete search history.

(56) References Cited

U.S. PATENT DOCUMENTS

| | | | | |
|---|---|---|---|---|
| 6,498,859 | B2 * | 12/2002 | Kuerti | H04R 3/002 381/361 |
| 2002/0168079 | A1 * | 11/2002 | Kuerti | H04R 3/002 381/361 |
| 2006/0083390 | A1 * | 4/2006 | Kaderavek | H04R 1/38 381/92 |
| 2009/0180656 | A1 * | 7/2009 | Benditt | H04R 1/08 381/362 |
| 2009/0316927 | A1 * | 12/2009 | Ferrill | H04R 1/02 381/91 |
| 2011/0135118 | A1 * | 6/2011 | Osborne | H04R 1/08 381/122 |
| 2016/0140946 | A1 * | 5/2016 | Kendall, Sr. | G10H 3/26 381/62 |

* cited by examiner

*Primary Examiner* — Sean H Nguyen
(74) *Attorney, Agent, or Firm* — Haug Partners LLP

(57) ABSTRACT

Thus there is provided a guitar amplifier microphone unit including at least one microphone capsule having a respective microphone capsule holder and a frame for holding the at least one microphone capsule holder. The at least one microphone capsule holder is arranged displaceably and/or rotatably on the frame.

17 Claims, 8 Drawing Sheets

GUITAR AMPLIFIER MICROPHONE UNIT

The present application claims priority from German Patent Application No. 10 2015 121410.5 filed on Dec. 9, 2015, the disclosure of which is incorporated herein by reference in its entirety.

FIELD OF THE INVENTION

It is noted that citation or identification of any document in this application is not an admission that such document is available as prior art to the present invention.

The present invention concerns guitar amplifier microphone unit.

To detect the audio output signal of a guitar amplifier it is known to place microphones in a stand in front of the guitar amplifier. In that case it is to be noted that, when detecting an audio signal of a guitar amplifier, there are various influencing parameters like for example the type of transducer of the microphone capsule (dynamic, electrostatic, ribbon), the spacing relative to the loudspeaker of the guitar amplifier, the position of the microphone in relation to the loudspeaker, the angle between the microphone and the loudspeaker axis, mixing together of microphones at different positions and mixing together different types of microphones.

FIG. 6 shows a typical arrangement of a microphone in front of a guitar amplifier according to the state of the art. If a microphone 10 is provided at the center of the loudspeaker 200 of the guitar amplifier then the sound can be sharp and can have many pitches. It can however happen that no frequencies are missing from the detected audio signal so that the signal does not have a very punchy sound. The further the microphone is placed towards the edge of the loudspeaker the correspondingly more do the lower frequencies determine the detected sound. This means that the sound becomes more central, warmer and more punchy, but it can happen that it loses transparency. The angle between the microphone and the loudspeaker also plays a part. If the microphone is turned in the direction of the edge of the loudspeaker then the detected audio signal gains in terms of low frequencies. If the microphone is placed at the edge of the loudspeaker and moved in the direction of the center of the loudspeaker then the sound gains in pitches.

SUMMARY OF THE INVENTION

Therefore an object of the present invention is to provide a guitar amplifier microphone unit which permits improved and reproducible detection of an audio output signal of a guitar amplifier.

Thus there is provided a guitar amplifier microphone unit having at least one microphone capsule having a respective microphone capsule holder and a frame for holding the at least one microphone capsule holder. The at least one microphone capsule holder is arranged displaceably and/or rotatably in or on the frame. The frame defines a plane. A mechanically protected volume is produced by the frame. The microphone capsule holder is provided within that volume. The frame has a flat sound inlet element having a first plane which can be directed in defined and frontal relationship towards a loudspeaker of the guitar amplifier.

In that way the microphone capsule can be displaced and/or rotated within the frame or on the frame by means of the microphone capsule holder. That permits reproducible positioning of the microphone capsule with respect to a loudspeaker of a guitar amplifier. The notion here is that the frame with the flat sound inlet element is of such a configuration that the frame can be easily reproducibly moved into a given position and orientation with respect to the guitar amplifier. It is for example usual to clamp a cable for a microphone for taking off from a guitar amplifier fixedly on the top side of the guitar amplifier and for the microphone to be suspended from that cable in such a way that the microphone housing contacts a sound outlet region of the guitar amplifier. A flat design configuration in respect of a sound inlet side of the microphone housing then defines a given, easily reproducible orientation of the microphone housing with respect to the sound outlet region of the guitar amplifier. According to the invention the microphone capsule of the microphone unit can now be optionally displaced by a user within the housing in all three spatial directions and optionally rotated and fixed in the new position with respect to the housing. By virtue of the positioning and orientation of the microphone capsule the user can select a location and an angle for the microphone capsule with respect to the sound outlet region of the guitar amplifier, which provides sound detection as the user wishes. The microphone unit designed according to the invention makes it possible to easily regain the found position for the capsule even after dismantling and transportation of the guitar amplifier and the microphone unit, at another event location. For that purpose only the microphone housing has to be moved again into the easily reproducible position with respect to the sound outlet region of the guitar amplifier. The microphone capsule which is fixed in the interior of the microphone housing has retained the previously selected position so that time-consuming re-orientation is not required.

The frame can be of a continuous or non-continuous configuration.

According to an aspect of the present invention the microphone unit has an output connection for electrical output signals. That output connection can have an XLR plug.

According to a further aspect of the present invention an end of the at least one microphone capsule holder projects beyond the frame and can be operated or actuated by a user. Alternatively or additionally actuators can be provided for displacing or rotating the microphone capsule holder.

According to a further aspect of the present invention the microphone capsule holder can be fixed in or to the frame.

According to a further aspect of the present invention the microphone unit has two microphone capsules respectively having a microphone capsule holder, which optionally projects beyond the frame so that the angle of the microphone capsule is adjustable by actuation of the first end of the respective microphone capsule holder.

DETAILED DESCRIPTION OF EMBODIMENTS

It is to be understood that the figures and descriptions of the present invention have been simplified to illustrate elements that are relevant for a clear understanding of the present invention, while eliminating, for purposes of clarity, many other elements which are conventional in this art. Those of ordinary skill in the art will recognize that other elements are desirable for implementing the present invention. However, because such elements are well known in the art, and because they do not facilitate a better understanding of the present invention, a discussion of such elements is not provided herein.

The present invention will now be described in detail on the basis of exemplary embodiments.

Figure 1:
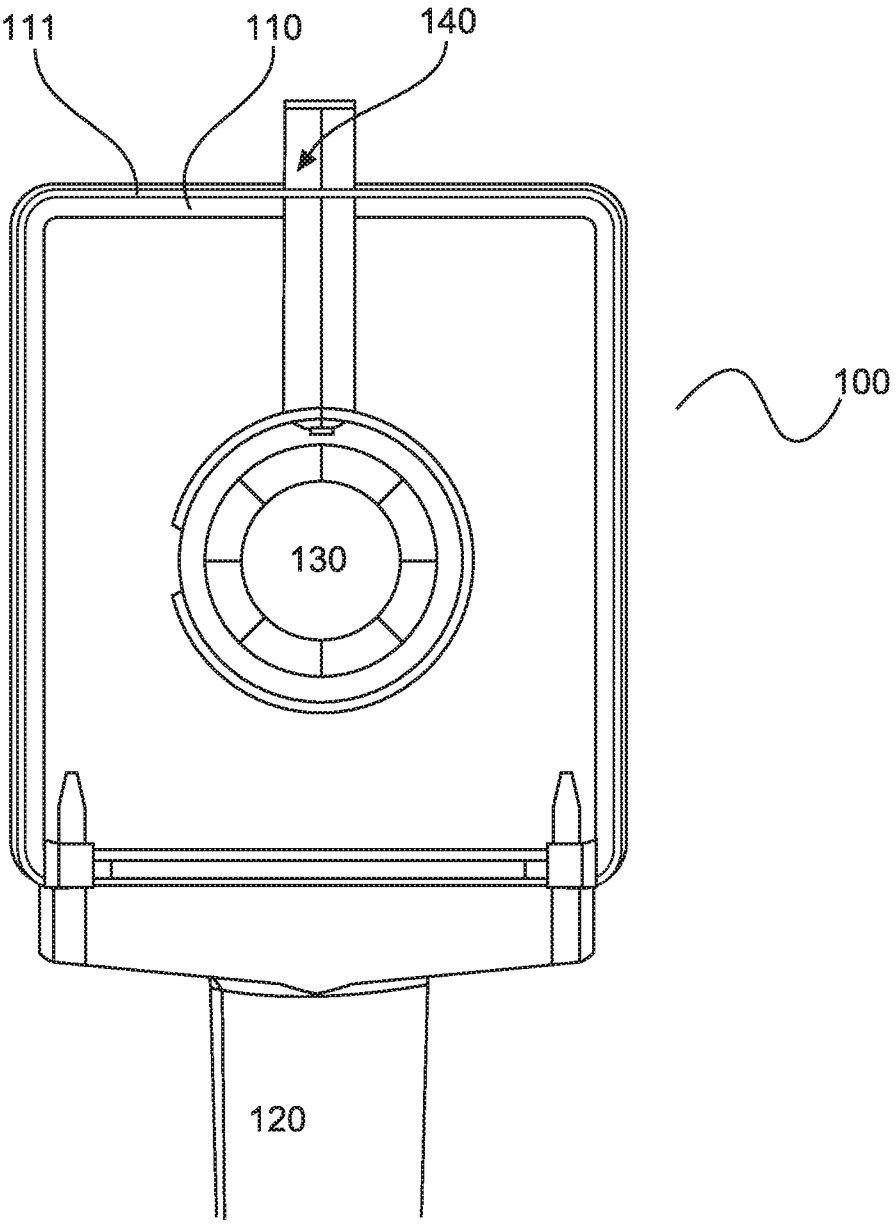
FIGS. 1 and 2 each show a diagrammatic view of a guitar amplifier microphone unit according to a first embodiment.
Figure 2:
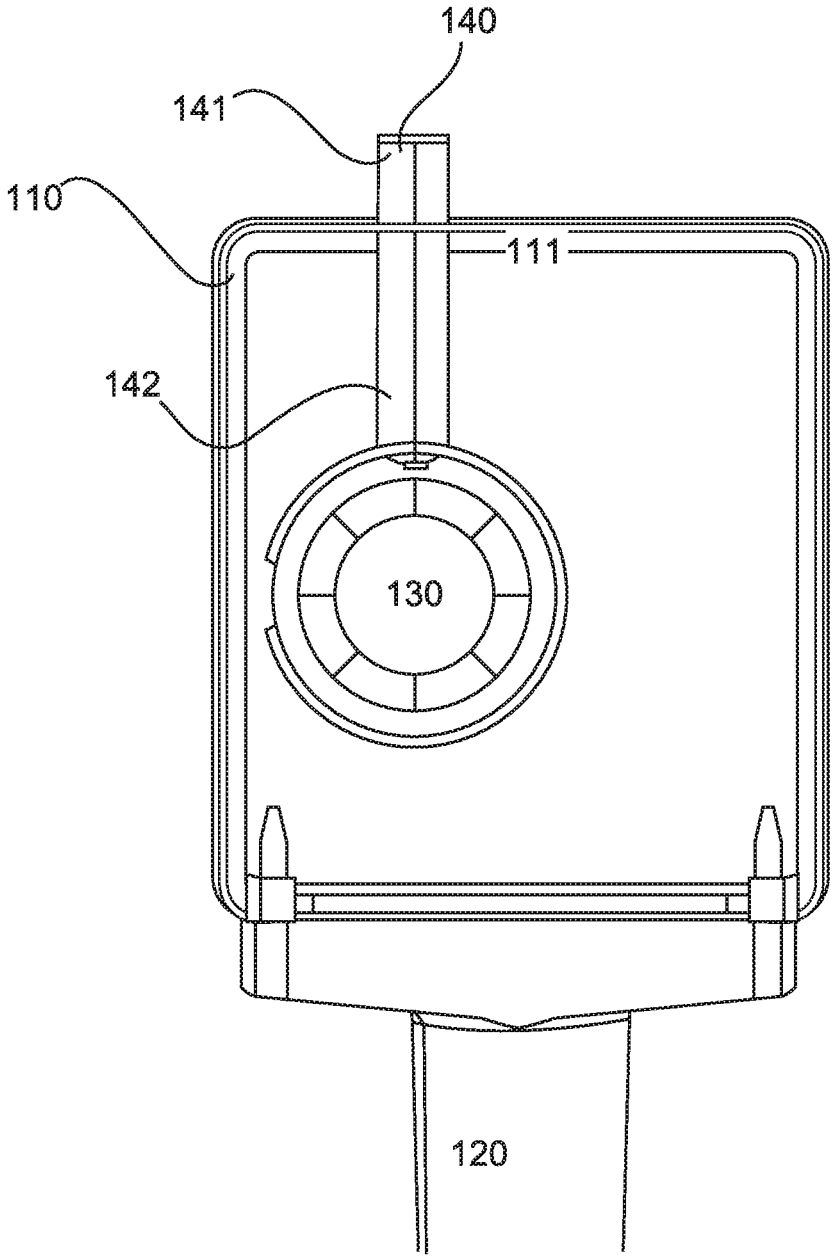
Figure 3A:
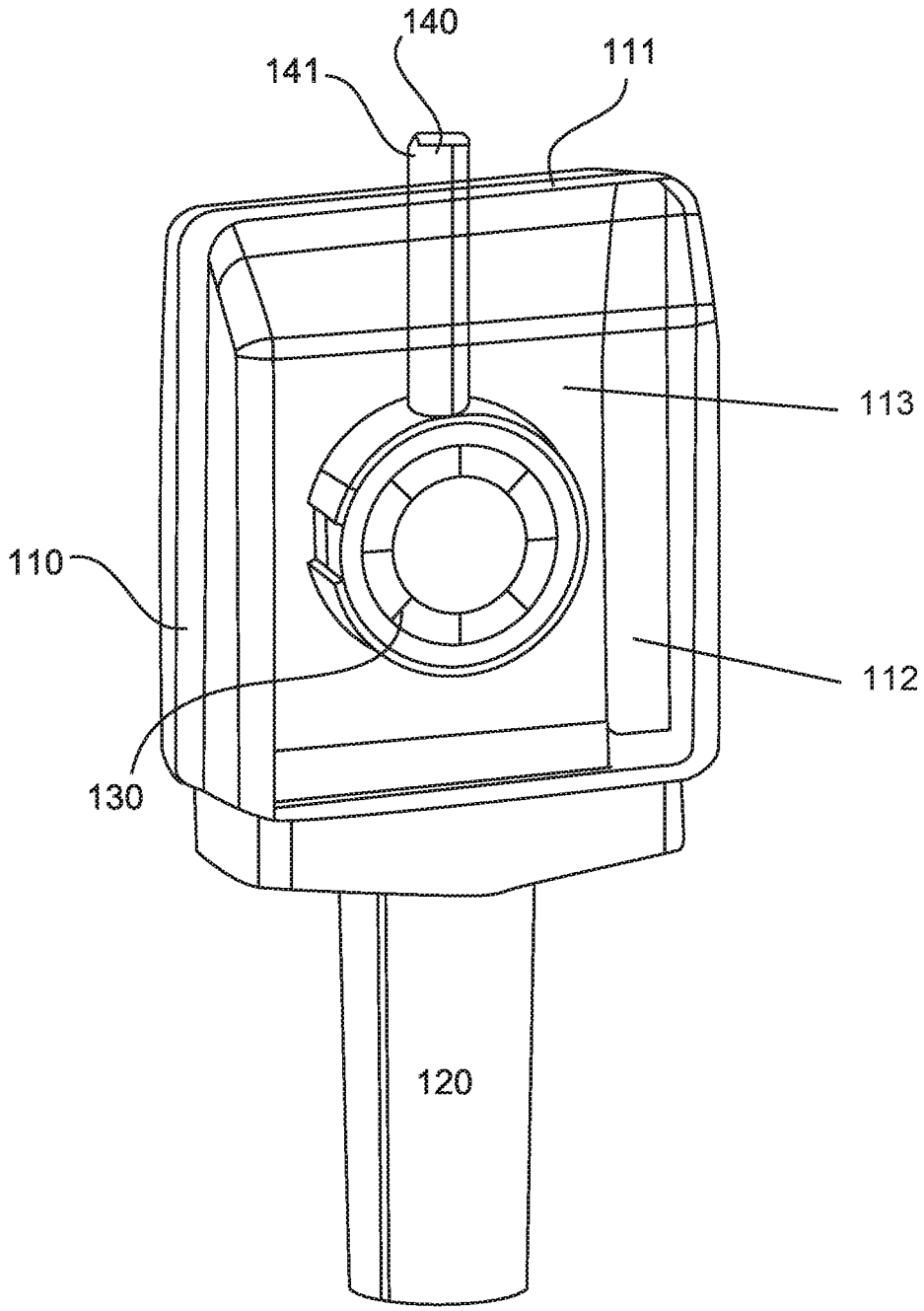
FIGS. 3A through 3D each show a diagrammatic view of a guitar amplifier microphone unit according to a second embodiment.
Figure 3B:
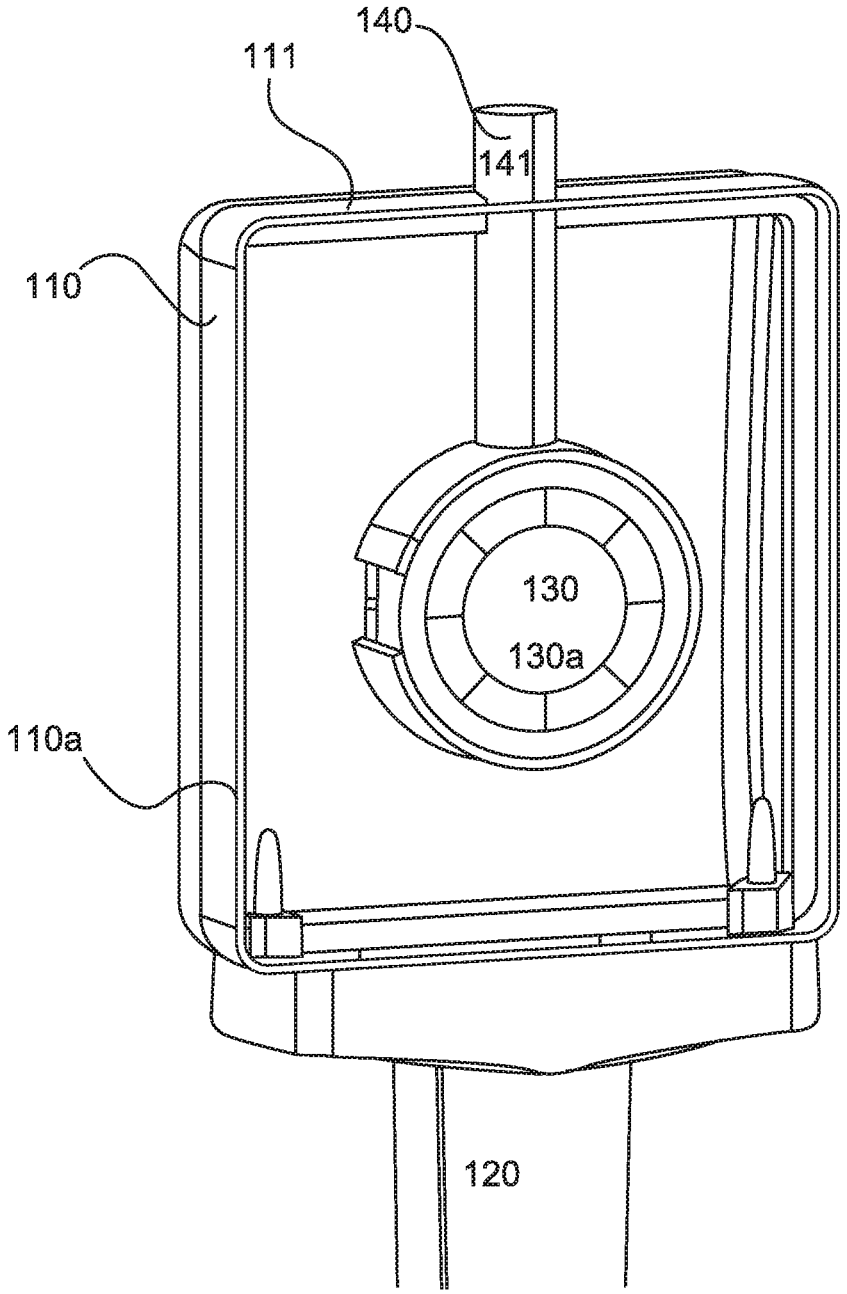
Figure 3C:
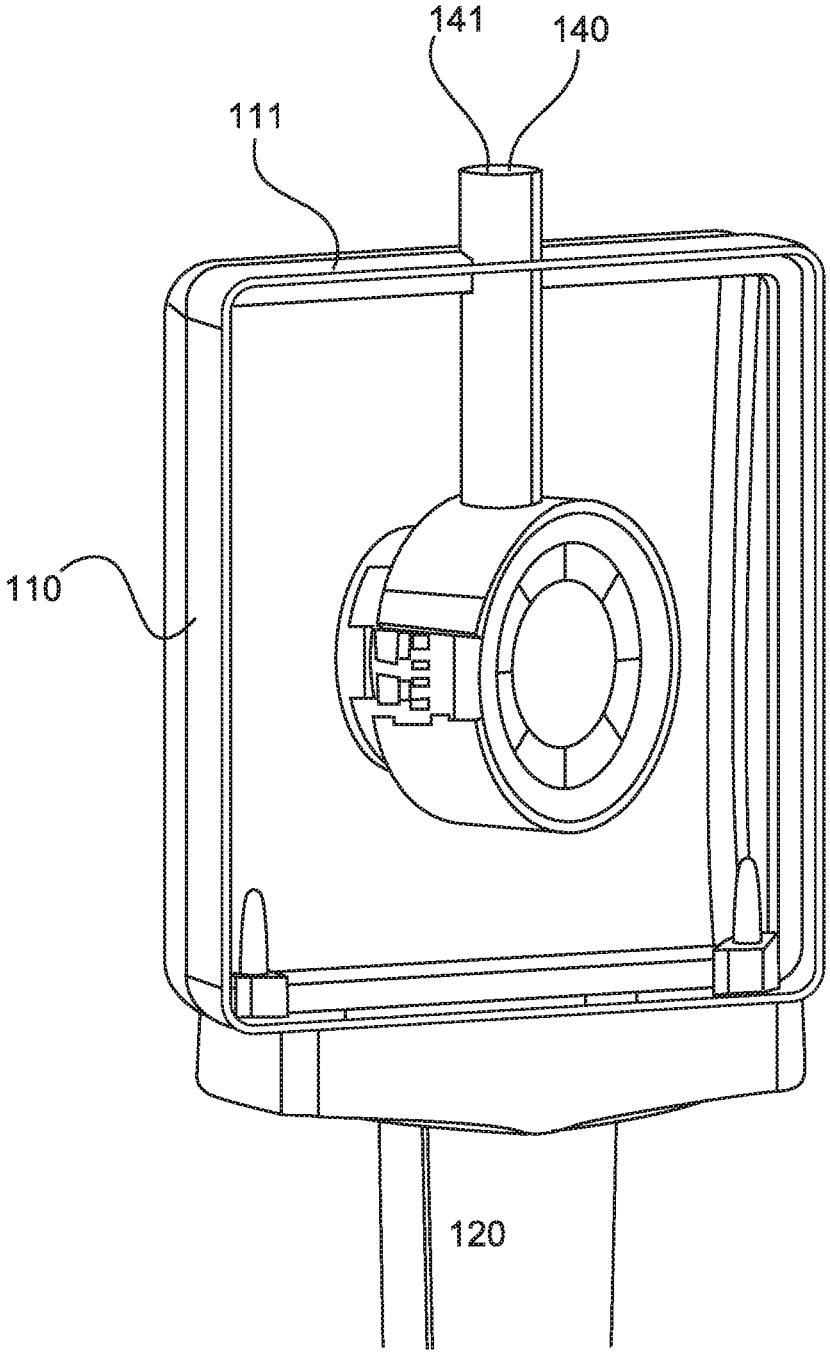
Figure 3D:
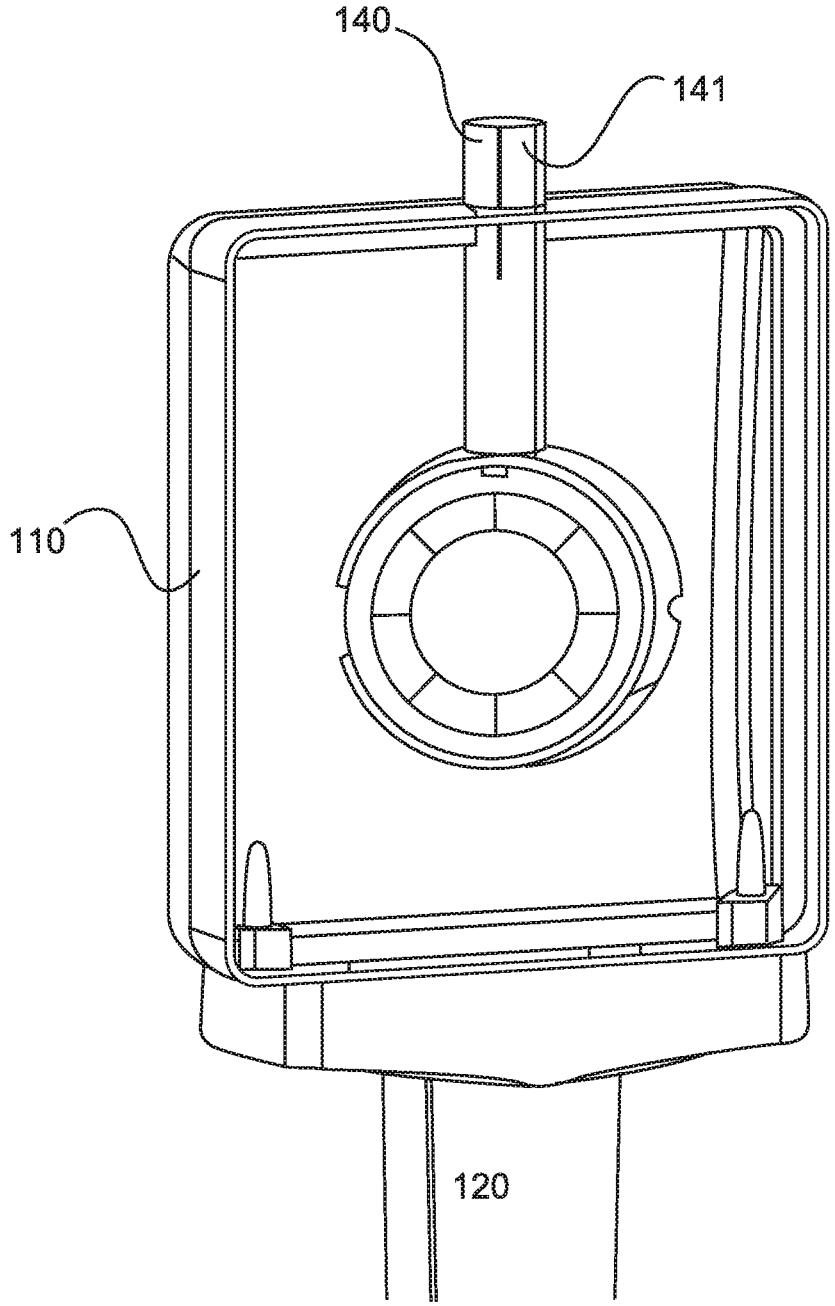

FIGS. 1 and 2 each show a diagrammatic view of a guitar amplifier microphone unit according to a first embodiment. The guitar amplifier microphone unit 100 has a frame 110, an output connection 120, and a microphone capsule 130 with a microphone capsule holder 140. The holder 140 has a first end 141 which projects beyond the frame 110 and a second end 142 connected to the microphone capsule 130. A slot 111 can be provided in the frame 110. The holder 140 can be moved along the slot 111. In that way the position of the microphone capsule 130 can be varied along the slot 111. FIGS. 1 and 2 show the microphone capsule in two different positions. The angle or the orientation of the microphone capsule can also be adjusted.

Optionally there can be provided a fixing unit for fixing the holder 140 in or to the frame 110.

Optionally the frame 110 can also be in the form of a housing or the frame 110 can be part of a housing.

FIGS. 3A through 3D each show a diagrammatic view of a guitar amplifier microphone unit according to a second embodiment. The guitar amplifier microphone unit according to the second embodiment can be based on the guitar amplifier microphone unit according to the first embodiment. The microphone unit 100 thus has a frame 110, an output connection 120 (for example an XLR plug/jack), and a microphone capsule 130 with a microphone capsule holder 140. A first end 141 of the holder 140 projects beyond the frame 110 so that the user can rotate or pivot the microphone capsule 130 by actuating or operating the first end 141 of the holder 140. The angle of the microphone capsule can be adjusted in that way. FIGS. 3A through 3D show the microphone capsule 130 at different angles with respect to the frame 110.

The frame 110 can span a first plane 110*a*. The microphone capsule 130 can span a second plane 130*a*. The angle between the first plane 110*a* of the frame and the second plane 130*a* of the microphone capsule 130 is varied by rotating the microphone capsule 130. The frame defines or produces a mechanically protected volume, within which the at least one microphone capsule is provided. The frame has a flat sound inlet element 112 having a flat side 113. The flat side 113 of the sound inlet element can be oriented definedly and frontally on to a loudspeaker of the guitar amplifier. The mechanically protected volume can be closed off by a grill or a mesh. The flat side 113 of the flat sound inlet element 112 can be provided by a flat grill or by a substantially flat portion of a mesh.

Optionally the frame 110 can have a slot 111 so that in addition the position of the microphone can be varied along the slot 111, as has been described hereinbefore for example in the first embodiment.

Figure 4:
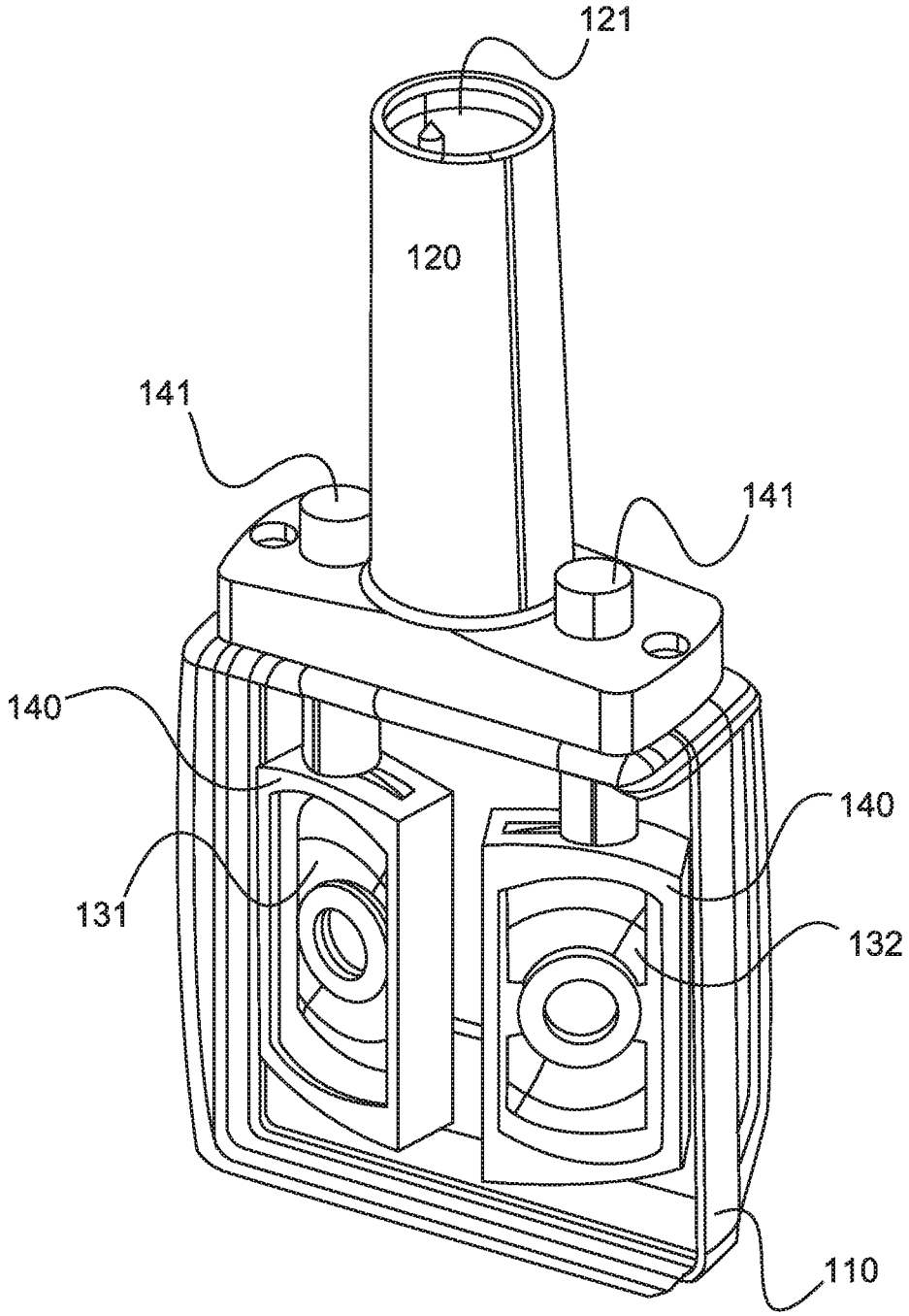
FIG. 4 shows a diagrammatic view of a guitar amplifier microphone unit according to a third embodiment.

FIG. 4 shows a diagrammatic view of a guitar amplifier microphone unit according to a third embodiment. The guitar amplifier microphone unit according to the third embodiment can be based on the guitar amplifier microphone units of the first and second embodiments. The guitar amplifier microphone unit 100 according to the third embodiment has a frame 110, an output connection 120 and two microphone capsules 131, 132 which each have a respective microphone capsule holder 140. The ends of the microphone capsule holders 140 project beyond the frame 110 so that they are operable (for example rotatable) by a user. In accordance with the third embodiment the angle of the two microphone capsules 131, 132 can be adjusted with respect to the first plane 110*a* which is defined by the frame 110, by actuation or rotation of the microphone capsule holders 140.

As in accordance with the third embodiment a dedicated microphone capsule holder is associated with each capsule a user can individually adjust the angles of the respective microphone capsules.

The output connection 120 can have an XLR plug 121. The electrical output signals of the microphone capsules 131, 132 can be passed outwardly by way of the output connection 120. That can be implemented for example by an XLR plug, that is to say the signals of the individual capsules 131, 132 can be brought together within the microphone and then output as an overall signal.

As an alternative thereto the output connection 120 can have an XLR5 plug 121 so that the signals of the capsules can be individually passed outwardly.

That is advantageous because that can afford wider possible options for post-processing of the signals of the respective microphone capsules.

According to an aspect of the invention the microphone unit can be positioned centrally between a transition between the dome and a corrugation.

Figure 5A:
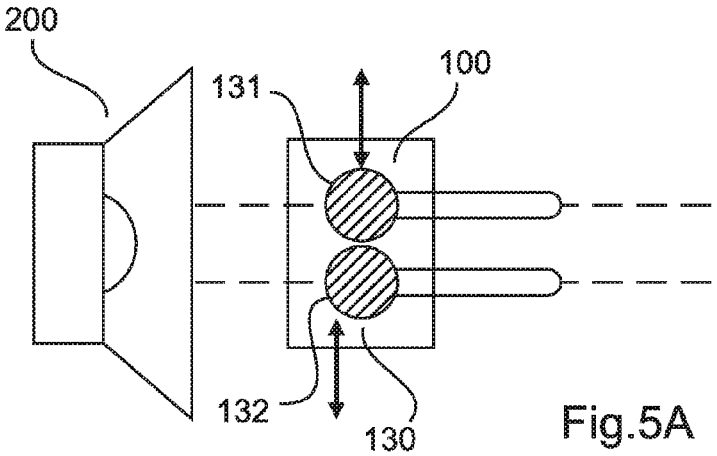
FIGS. 5A and 5B each show a diagrammatic view of a mode of operation of a guitar amplifier microphone unit according to a fourth embodiment.

FIGS. 5A and B each show a diagrammatic view of a mode of operation of a guitar amplifier microphone unit according to a fourth embodiment. The microphone unit 100 according to the invention with the microphone capsules 131, 132 can be directed for example centrally on to the transition between a dome and a corrugation of the loudspeaker 200 of the guitar amplifier 20. A microphone capsule 131, 132 can then detect the signal at the corrugation of the loudspeaker and another microphone capsule can detect the signal at the dome.

Figure 5B:
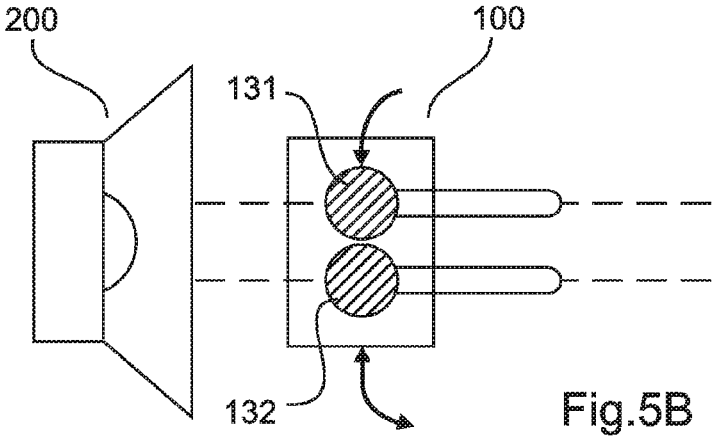
Figure 6:
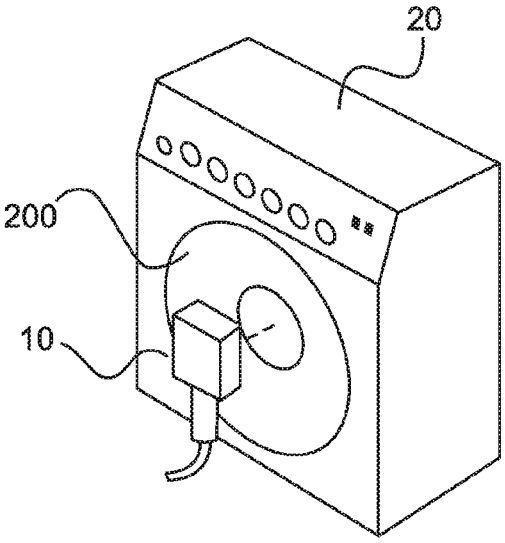
FIG. 6 shows a typical arrangement of a microphone in front of a guitar amplifier in accordance with the state of the art.

The detected sound can be varied by rotating (FIG. 5B) or displacing (FIG. 5A) the microphone capsules 131, 132 without in that case changing the position of the microphone unit 100 per se.

According to an aspect of the present invention a plurality of capsules, if there are a plurality of capsules, can be arranged as closely as possible to each other to avoid phase problems.

According to a fifth embodiment the width of the microphone unit can be so selected that it corresponds to half the diameter of the loudspeaker 200. In that case it would be possible to position as many capsules as possible so that many different audio signals can be detected at the same time at various locations of the loudspeaker.

According to an aspect of the present invention there can be provided actuators, for example motors, on the frame or the microphone capsule holders so that rotation or displacement of the microphone capsule holder can be permitted for example electrically. It is thus possible to dispense with manual adjustment of the position and/or angle of the microphone capsules. Optionally that adjustment can be effected by means of a remote control.

Optionally the microphone unit can have a light unit, for example in the form of an LED or laser diodes, for lighting up, in order to be able to better determine the position of the microphone unit in relation to the loudspeaker.

While this invention has been described in conjunction with the specific embodiments outlined above, it is evident that many alternatives, modifications, and variations will be apparent to those skilled in the art. Accordingly, the preferred embodiments of the invention as set forth above are intended to be illustrative, not limiting. Various changes may be made without departing from the spirit and scope of the inventions as defined in the following claims.

The invention claimed is:

1. A guitar amplifier microphone unit for a guitar amplifier, comprising:

at least one microphone capsule with an associated microphone capsule holder;

a frame configured to hold the at least one microphone capsule holder; and a mechanically protected volume that is produced by the frame, and within which the at least one microphone capsule is provided;

wherein the frame has a flat sound inlet element having a flat side configured to be oriented definedly and frontally on to a loudspeaker of the guitar amplifier; and wherein the at least one microphone capsule holder is adapted so that a horizontal position and an orientation of the at least one microphone capsule with respect to the frame can be thereby adjusted and fixed within the protected volume by a user.

2. The guitar amplifier microphone unit as set forth in claim 1, further comprising:

an output connection configured to output electrical output signals of the microphone capsule.

3. The guitar amplifier microphone unit as set forth in claim 1;

wherein an end of the at least one microphone capsule holder projects beyond the frame and is operable or actuable by a user.

4. The guitar amplifier microphone unit as set forth in claim 1, further comprising:

a second microphone capsule with an associated second microphone capsule holder;

wherein the second microphone capsule holder is adapted so that a position and/or orientation of the second microphone capsule with respect to the frame can be thereby adjusted and fixed within the protected volume by the user.

5. The guitar amplifier microphone unit as set forth in claim 1;

wherein the at least one microphone capsule holder is actuable by actuators.

6. The guitar amplifier microphone unit as set forth in claim 1, further comprising: a fixing unit configured to fix the at least one microphone capsule holder in or to the frame.

7. The guitar amplifier microphone unit as set forth in claim 1;

wherein the mechanically protected volume is closed off by a grill or a mesh.

8. A microphone unit for a guitar amplifier, comprising:

a frame having a protected volume formed by a dome and a flat sound inlet element, the flat sound inlet element having a flat side to be arranged in front of a speaker of the guitar amplifier; and two microphone capsules provided in the protected volume and fixed to the frame by two microphone capsule holders, respectively, wherein the microphone capsule holders are configured to allow a user to adjust an orientation of the microphone capsules with respect to the frame.

9. The microphone unit according to claim 8, wherein the microphone capsule holders are configured to allow a user to individually adjust the orientation of each microphone capsule.

10. The microphone unit according to claim 8, wherein the microphone capsule holders are configured to allow a user to adjust a horizontal position of the microphone capsules relative to the frame.

11. The microphone unit according to claim 8, wherein each of the two microphone capsules is configured to detect different audio signals.

12. The microphone unit according to claim 11, where one of the two microphone capsules is configured to detect an audio signal produced by a corrugation of the speaker, while another one of the two microphone capsules is configured to detect an audio signal at the dome.

13. The microphone unit according to claim 8, further comprising:

an XLR plug configured to individually output signals of the two microphone capsules.

14. The microphone unit according to claim 8, further comprising:

a plurality of microphone capsules in addition to the two microphone capsules.

15. The microphone unit according to claim 14, wherein the plurality of the microphone capsules and the two microphone capsules are arranged centrally in front of the speaker.

16. The microphone unit according to claim 8, wherein a width of the microphone unit is selected according to a half diameter of the speaker.

17. The microphone unit according to claim 8, wherein the microphone capsule holders have a motor that is capable of electrically adjusting orientation of the microphone capsules.

* * * * *